US007984814B2

(12) United States Patent
Didehvar

(10) Patent No.: US 7,984,814 B2
(45) Date of Patent: Jul. 26, 2011

(54) HANGER FOR SUSPENDING AT LEAST ONE OBJECT FROM A SUPPORT

(75) Inventor: Kaveh Didehvar, Hockessin (DE)

(73) Assignee: Zenith Products Corp., New Castle, DE (US)

( * ) Notice: Subject to any disclaimer, the term of this patent is extended or adjusted under 35 U.S.C. 154(b) by 0 days.

(21) Appl. No.: 12/899,743

(22) Filed: Oct. 7, 2010

(65) Prior Publication Data

US 2011/0017891 A1 Jan. 27, 2011

Related U.S. Application Data

(62) Division of application No. 11/971,502, filed on Jan. 9, 2008.

(51) Int. Cl.
*A47F 5/08* (2006.01)

(52) U.S. Cl. ..... 211/113; 211/13.1; 211/118

(58) Field of Classification Search ..... 211/113, 211/60.1, 70.6, 118, 94.02, 85.7, 45; 248/317, 248/318, 58; 206/349, 806; 220/751, 475, 220/481

See application file for complete search history.

(56) References Cited

U.S. PATENT DOCUMENTS

| | | | |
|---|---|---|---|
| 809,441 | A | 1/1906 | Hanks |
| 961,050 | A | 6/1910 | Wakefield |
| D157,780 | S | 3/1950 | Oppermann, Jr. |
| 2,979,192 | A | 4/1961 | Blonder |
| 3,192,894 | A | 7/1965 | Staver |
| D201,926 | S | 8/1965 | Roach |
| 3,273,766 | A | 9/1966 | Cosentino |
| D207,411 | S | 4/1967 | Diesinger |
| 3,606,948 | A | 9/1971 | Strang |
| 3,653,624 | A | 4/1972 | Abel |
| 4,062,450 | A | 12/1977 | Carter |
| 4,174,087 | A | 11/1979 | Gaines |
| 4,278,225 | A | 7/1981 | Phelps |
| 4,712,671 | A | 12/1987 | Salacuse |
| 4,738,369 | A | 4/1988 | Desjardins |
| 4,804,144 | A | 2/1989 | Denman |
| D321,639 | S | 11/1991 | Adams |
| 5,085,326 | A | 2/1992 | Russell et al. |
| 5,170,978 | A | 12/1992 | Hoffman |
| 5,297,766 | A | 3/1994 | Hoffman |
| 5,372,346 | A | 12/1994 | Upchurch et al. |
| 5,701,998 | A | 12/1997 | Perry et al. |
| 5,829,590 | A | 11/1998 | Klein |
| 5,871,105 | A | 2/1999 | Whitehead et al. |
| 5,960,967 | A | 10/1999 | Neil |
| 6,006,928 | A | 12/1999 | Parker |
| 6,059,125 | A | 5/2000 | Parham |

(Continued)

OTHER PUBLICATIONS

Office Action Issued Oct. 14, 2010 in U.S. Appl. No. 11/971,502.

(Continued)

*Primary Examiner* — Jennifer E. Novosad
(74) *Attorney, Agent, or Firm* — Panitch Schwarze Belisario & Nadel LLP

(57) ABSTRACT

A combination support and hanger for suspending at least one object, wherein the support includes at least one orthogonally extending slot located between at least two legs. The hanger includes a base having a top surface, a bottom surface and a cap extending from the top surface of the base. Further, the cap is slideably and removably positioned within the at least one slot and the cap mutually engages the at least two legs to suspend the at least one object secured to the base.

10 Claims, 6 Drawing Sheets

U.S. PATENT DOCUMENTS

| | | | |
|---|---|---|---|
| 6,079,559 | A | 6/2000 | Lee |
| 6,131,779 | A | 10/2000 | Gendala |
| 6,142,313 | A | 11/2000 | Young |
| 6,203,279 | B1 | 3/2001 | Moody et al. |
| 6,250,466 | B1 | 6/2001 | Ernst |
| 6,318,690 | B1 | 11/2001 | Chang et al. |
| D451,800 | S | 12/2001 | Pryde et al. |
| 6,360,902 | B1 | 3/2002 | Searles |
| 6,378,719 | B1 | 4/2002 | Kaiser |
| 6,454,231 | B1 | 9/2002 | Fischer |
| 6,464,840 | B1 | 10/2002 | McCann |
| 6,536,611 | B2 | 3/2003 | Chen |
| 6,758,350 | B2 | 7/2004 | Lin |
| 6,834,767 | B1 | 12/2004 | Lin |
| 6,863,185 | B2 | 3/2005 | Mele et al. |
| 7,090,085 | B1 | 8/2006 | Vicendese et al. |
| 7,306,191 | B1 | 12/2007 | Chen |
| D576,475 | S | 9/2008 | Didehvar |
| 7,434,700 | B2 | 10/2008 | Kao |
| 7,445,185 | B1 | 11/2008 | Cicero |
| 7,861,871 | B2 | 1/2011 | Kao |
| 2003/0019775 | A1 | 1/2003 | Ernst |
| 2004/0094444 | A1 | 5/2004 | Chen |
| 2004/0173485 | A1 | 9/2004 | Huang |
| 2005/0230335 | A1 | 10/2005 | Chiu et al. |
| 2006/0207951 | A1 | 9/2006 | Wang |
| 2006/0226321 | A1 | 10/2006 | Tracy |
| 2007/0102381 | A1 | 5/2007 | Nguy et al. |
| 2008/0128370 | A1 | 6/2008 | Shih |
| 2010/0065519 | A1 | 3/2010 | Nguy et al. |

OTHER PUBLICATIONS

Office Action Issued Mar. 9, 2011 in U.S. Appl. No. 11/971,502.

HANGER FOR SUSPENDING AT LEAST ONE OBJECT FROM A SUPPORT

CROSS-REFERENCE TO RELATED APPLICATIONS

This application is a divisional of U.S. patent application Ser. No. 11/971,502, filed Jan. 9, 2008.

BACKGROUND OF THE INVENTION

The present invention is directed to a hanger for suspending at least one object from a support and, more particularly, to a hanger or support to hang an elongated rod.

Display devices or display packages are relatively common in the commercial retail industry for hanging objects or items to be sold from a support, such as a display rack, a display case or directly from a wall. A typical display device includes an extension or flange extending from a base or housing of the display device to vertically suspend an object. The extension or flange generally includes an opening to form a hanging member. Typically, a peg or bolt projects from the display case or wall and supports the display device at the extension by extending into the opening of the extension. These display devices can be used to vertically suspend any type of object, but it is often found that these display devices vertically suspend elongated members, such as rods used for hanging window curtains, shower curtains or the like.

In reference to FIGS. 1 and 2, a support or conventional retail display case 10 is used to vertically suspend one or more rods 12. The rods 12 include an enlarged head 22 of various shapes at each end of the rod 12 and a solid or tubular shaft 28 connecting the two enlarged heads 22. The conventional retail display cases 10 typically include a suspension rack 18 to vertically suspend the rods 12. The rods 12 are suspended from the rack 18 by sliding either enlarged head 22 of the rod 12 into one of several slots 20 of the rack 18. The conventional retail display cases 10 conveniently suspend rods 12 of a varying sizes and shapes directly from the suspension rack 18.

However, problems arise when the size and shape of the slots 20 cannot accommodate the various size and shapes of the heads 22 of various rods 12. For example, the shape of various enlarged heads 22 may not permit the head of the rod 12 from being slid within any of the several slots 20 of the suspension rack 18. Therefore, it would be desirable to create a hanger or packaging that would allow the retailer or user to hang a rod of a different shape from the retail support or display case 10. This would allow the retailer or user to sell different types of rods without having to purchase a new or different display case.

As is well known, the weight of most rods 12 is supported above the window, shower or the like by the force of the two heads 22 against opposing walls. It is important that the heads 22 are not damaged or scratched during sale or shipment of the rods 12 so that the heads 22 will not unnecessarily scratch the walls when the rods 12 are hung. Therefore, it would be desirable to provide a hanger or packaging for the rods 12 to protect the heads 22 of the rods 12 during sale, storage and shipment. Further, it would be desirable to create a hanger or packaging for a rod display 10 having a simple design and constructed of inexpensive material for ease and affordability in manufacturing such that the hanger or packaging can be disposed of after use.

BRIEF SUMMARY OF THE INVENTION

Briefly stated, the present invention is directed to a hanger for suspending at least one object from a support. The hanger includes a base having a top surface, a bottom surface and a cap extending from the top surface of the base. Further, packaging, having an upper and lower portion, at least partially encloses the base and at least partially encloses the at least one object for removably attaching the object to the base. The cap is removably engagable with the support and the hanger is removably attached to the at least one object by at least the packaging.

In another aspect, the present invention is directed to a combination support and hanger for suspending at least one object. The support includes at least one orthogonally extending slot located between at least two legs. The hanger includes a base having a top surface, a bottom surface and a cap extending from the top surface of the base. Further, the cap is slideably and removably positioned within the at least one slot and the cap mutually engages the at least two legs to suspend the at least one object secured to the base.

In yet another aspect, the present invention is directed to a hanger for suspending at least one object from a support. The hanger includes a base having a top surface and a bottom surface, a cap extending from the top surface of the base and at least one holding prong extending from the bottom surface of the base for engaging the at least one object. Further, the cap is removably engagable with the support and the hanger is removably attached to the at least one object.

BRIEF DESCRIPTION OF THE SEVERAL VIEWS OF THE DRAWINGS

The foregoing summary, as well as the following detailed description of preferred embodiments of the present invention, will be better understood when read in conjunction with the appended drawings. For the purpose of illustrating the invention described in the present application, there are shown in the drawings, embodiments which are presently preferred. It should be understood, however, that the invention is not limited to the precise arrangements and instrumentalities shown. In the drawings.

DETAILED DESCRIPTION OF THE INVENTION

Figure 1:
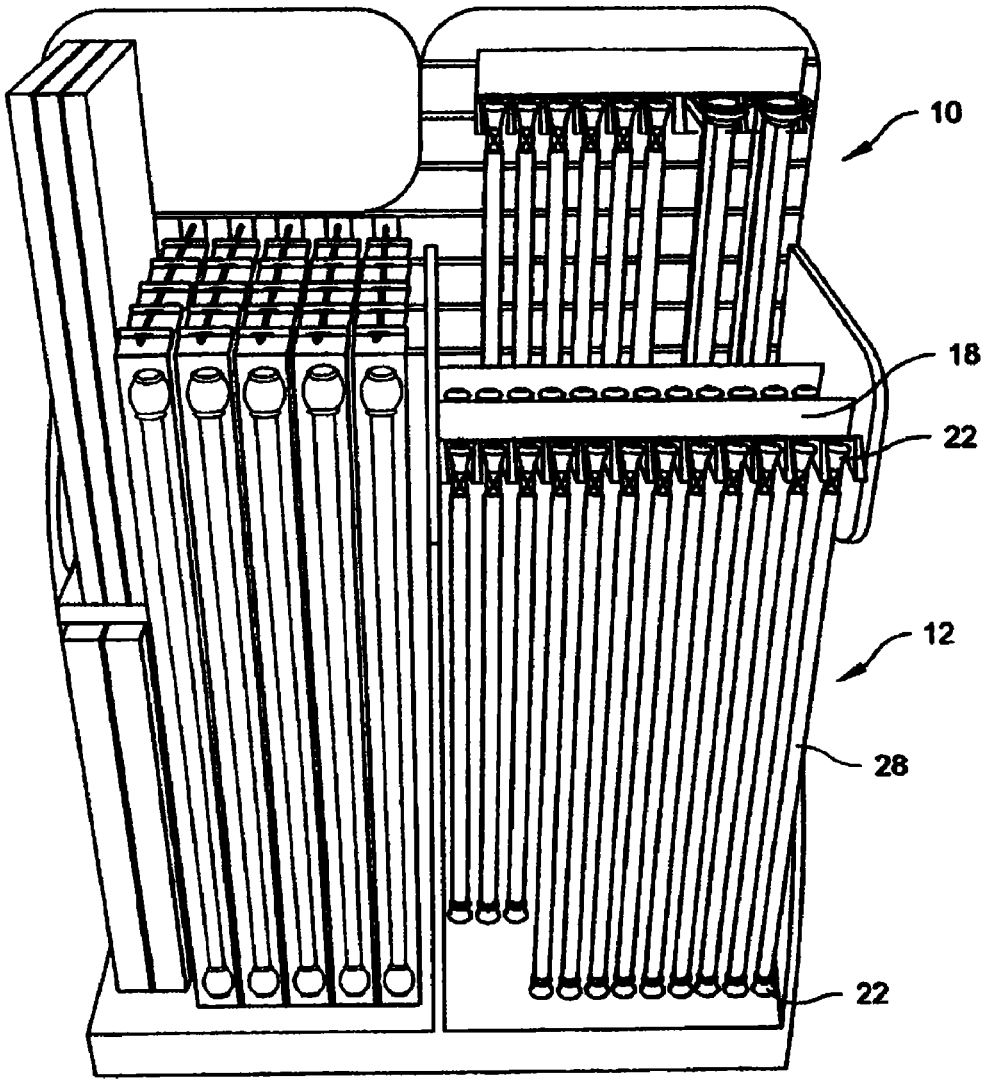
Fig. 1 (Prior Art)
FIG. 1 is a front perspective view of a support found in the prior art.

Certain terminology is used in the following description for convenience only and is not limiting. The words "right", "left", "lower" and "upper" designate directions in the drawings to which reference is made. The words "inwardly" and "outwardly" refer to directions toward and away from, respectively, the geometric center of the dispensing blender and designated parts thereof. The terminology includes the above-listed words, derivatives thereof and words of similar import.

Figure 3:
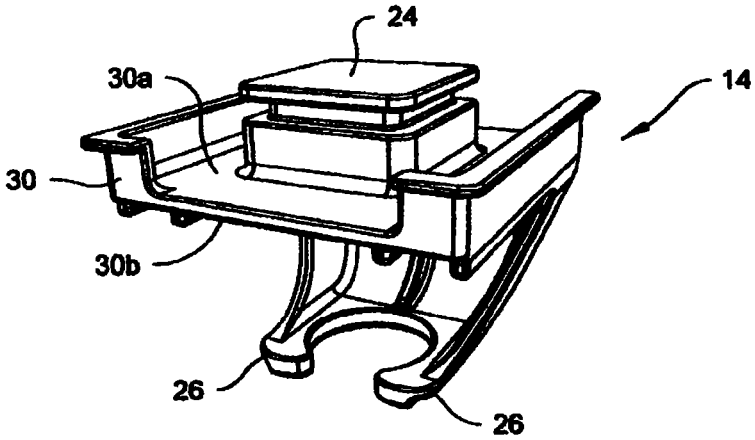
FIG. 3 is an front right perspective view of a first preferred embodiment of a hanger in accordance with the present invention.
Figure 4:
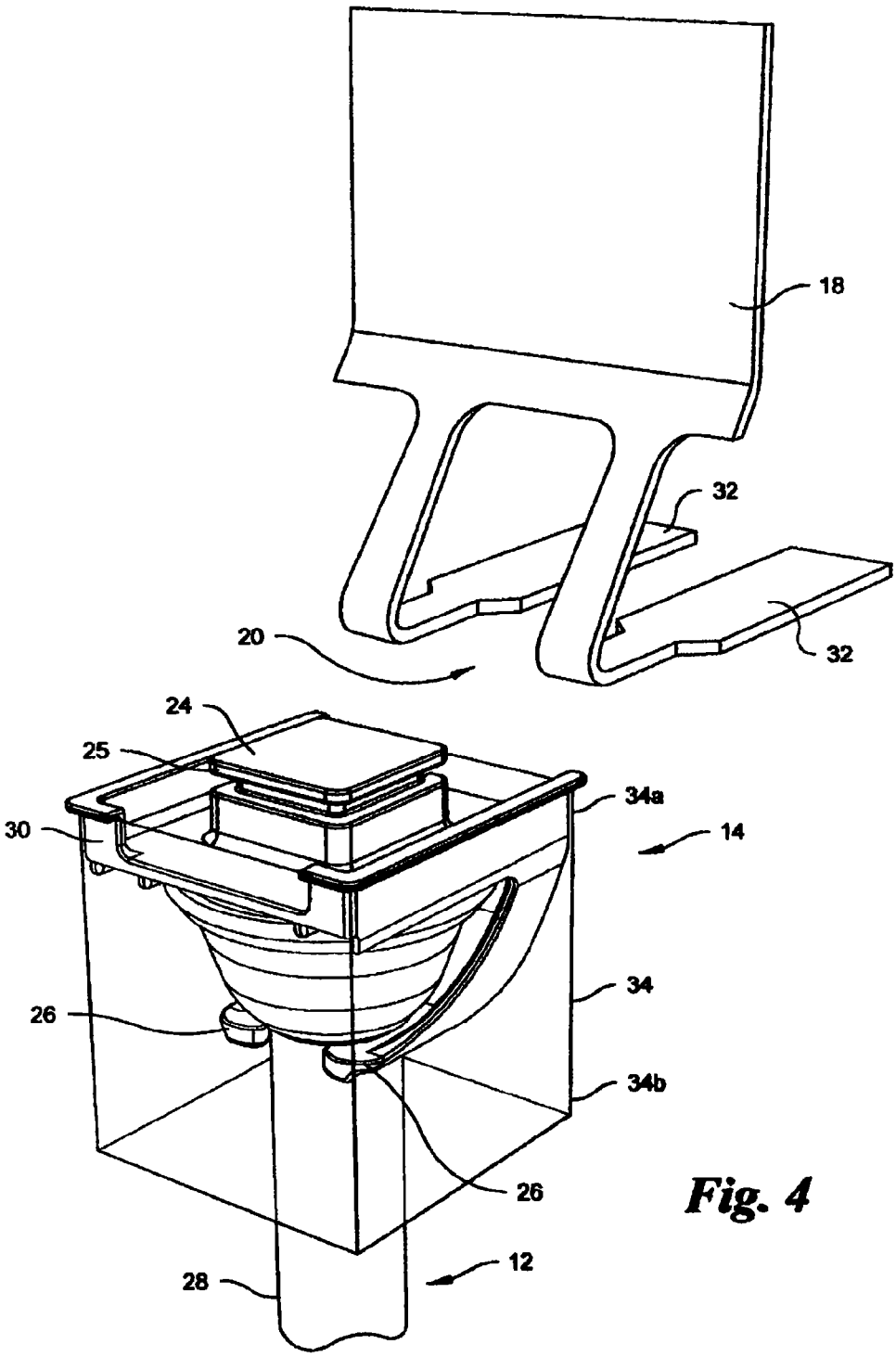
FIG. 4 is a front right perspective view of the hanger shown in FIG. 3 and a portion of the rack shown in FIG. 2.
Figure 5:
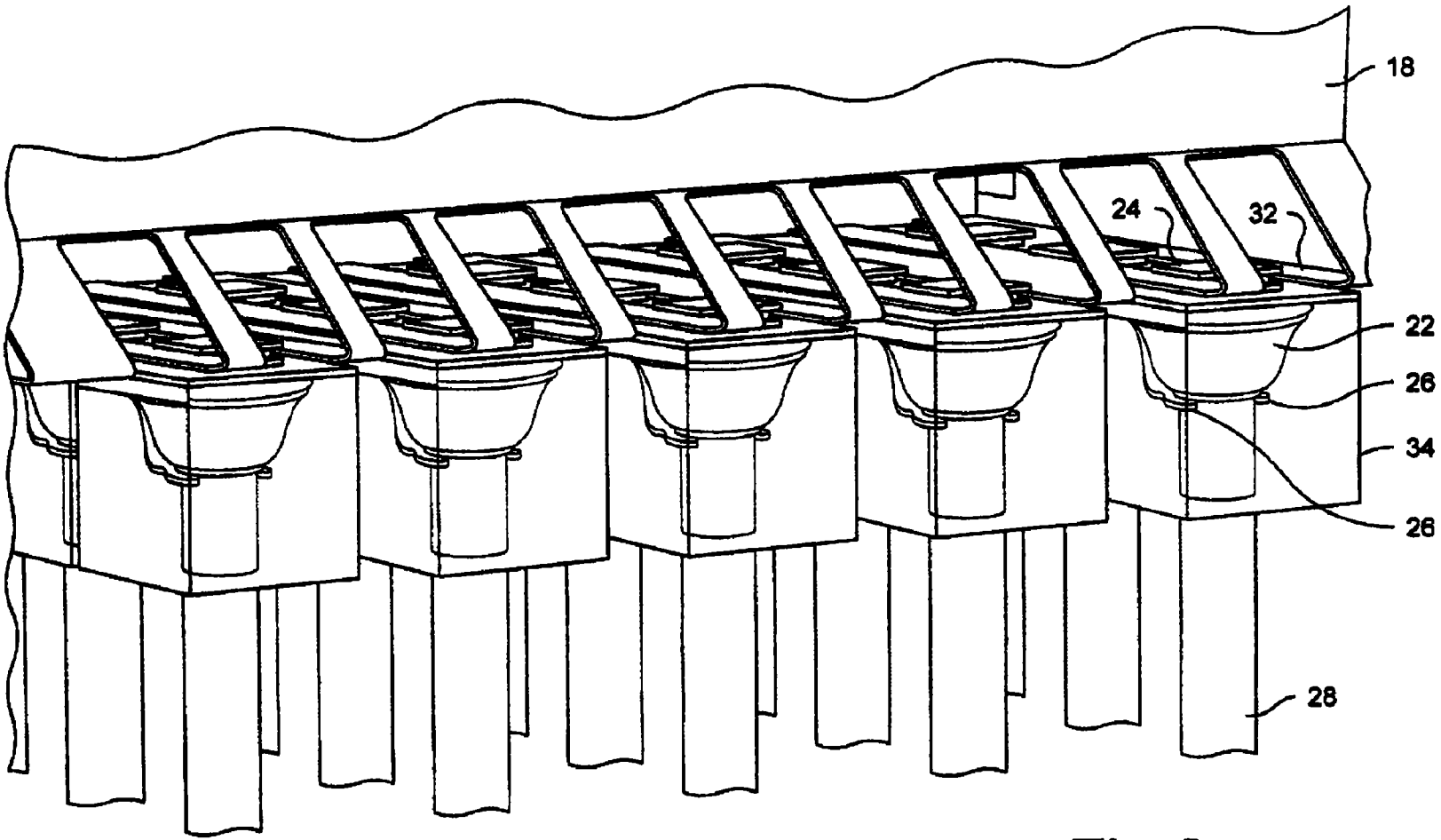
FIG. 5 is a front left perspective view of a plurality of hangers, as shown in FIG. 3, engaged with the rack, as shown in FIG. 2.

Referring now to the drawings in detail, wherein like numerals are used to indicate like elements throughout, there is shown in FIGS. 3-5 a first preferred embodiment of a hanger, generally designated 14, for suspending at least one object from a support, generally designated 10, in accordance with the present invention. The hanger 14 is preferably in the form of a display device or display packaging, but could be in the form of virtually any other product that is capable of displaying, hanging, or mounting objects. Preferably, the at least one object is an elongated member, such as an elongated rod 12 used for suspending window curtains (not shown), shower curtains (not shown) or the like. However, it is understood by those skilled in the art that the at least one object can be virtually any object that is capable of being suspended or displayed, such as a baseball bat, a cane, an umbrella, a mop, a doorknob, piping, a hose or the like. The hanger 14 is preferably formed of a high strength, lightweight material, such as a polymeric material. However, it is understood by those skilled in the art that the hanger 14 can be constructed of virtually any material, such as a metallic material, without departing from the spirit and scope of the invention.

Figure 2:
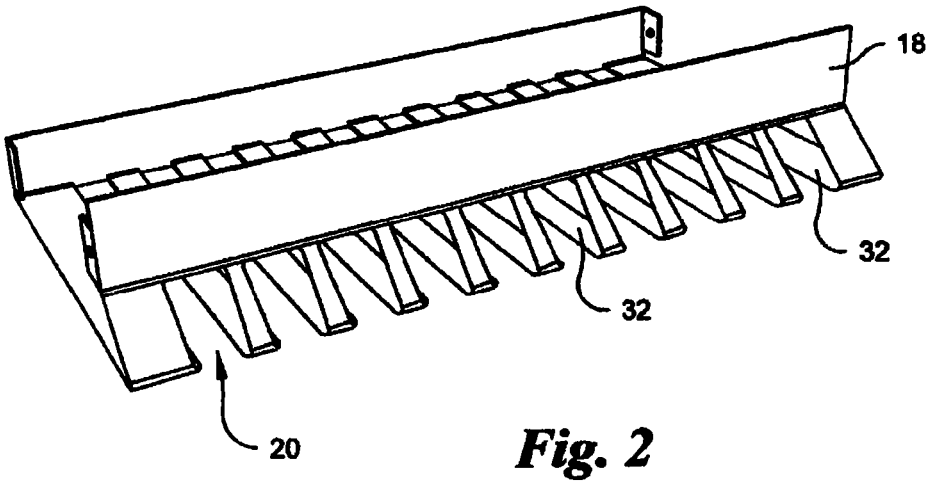
Fig. 2 (Prior Art)
FIG. 2 is a front left perspective view of a rack of the support found in the prior art.

As shown in FIGS. 1 and 2, the support 10 from which the hanger 14 suspends, is preferably in the form of a conventional retail display case, but can be virtually any support device capable of hanging or suspending objects. Preferably, the support 10 includes a suspension rack 18 to vertically suspend the at least one object. The rack 18 typically includes several spaced apart, generally parallel slots 20 and a plurality of spaced apart, generally parallel legs 32 which establish each one of the several slots 20. As shown in FIG. 4, each leg 32 includes a first free end and an opposing second end integrally formed with a remaining portion of the suspension rack 18. Both the first free end and the second end of each leg 32 includes an outer surface and an opposing inner surface facing the hanger 14 when the hanger 14 is attached to the support 10. A first distance measured between opposing inner surfaces of adjacent legs 32 at the second end of each leg 32 is greater than a second distance measured between opposing inner surfaces of adjacent legs 32 at the first free end of each leg 32. Such support devices or retail display cases 10 are relatively common in the commercial retail industry and are relatively well known by those skilled in the art.

Typically, in the prior art, the at least one object is suspended from the rack 18 by sliding a portion of the at least one object into one of the several slots 20 of the rack 18, as shown in FIG. 1. However, in the present invention, the at least one object is suspended from the rack 18 by sliding a portion of the hanger 14 into one of the several slots 20 of the rack 18. Specifically, as shown in FIG. 5, a portion of the hanger 14 is removably engagable with two of the plurality of legs 32 of the rack 18.

In reference to FIGS. 3-5, the hanger 14 includes a base 30, a cap 24 and at least one holding prong 26. The base 30 has a top surface 30*a* and a bottom surface 30*b*. The base 30 of the first preferred embodiment is preferably square in shape. However, it is understood by those skilled in the art that the form and shape of the base 30 can be modified, such as to be rectangular or circular in shape, without departing from the spirit and scope of the invention. The least one holding prong 26 extends from the bottom surface 30*b* of the base 30 for engaging at least a portion of the at least one object, or rod 12. The at least one holding prong 26 grasps the rod 12 to suspend the rod 12 from the support 10 when the cap 24 of the hanger 14 is engaged with the support 10, as shown in FIG. 5.

Preferably, the hanger 14 of the first preferred embodiment includes two generally parallel holding prongs 26, each being arcuate in shape, that extend from the bottom surface 30*b* of the base 30. The two holding prongs 26 receive a portion of the rod 12 to suspend the rod 12 from the rack 18 of the support 10. In the first preferred embodiment, an upper portion of the holding prongs 26 extend from an outer periphery of the bottom surface 30*b* of the base 30. However, it is understood by those skilled in the art that the shape, form and location of the holding prongs 26 can be modified without departing from the spirit and scope of the invention. For example, the holding prongs 26 can extend from a central portion of the base 30 or can be rectangular in shape.

In the first preferred embodiment, the two holding prongs 26 form an opening through which a shaft portion 28 of the rod 12 can pass through. When the holding prongs 26 receive a shaft portion 28 of the rod 12, a top surface of the rod 12 is in facing engagement with the bottom surface 30*b* of the base 30 (as shown in FIG. 4). The base 30 includes an outer wall extending from the top surface 30*a* and partially extending around the perimeter of the base 30.

The cap 24 extends from the top surface 30*a* of the base 30. The cap 24 is slideably and removably positioned within the at least one slot 20. Specifically, the cap 24 is removably engagable with the legs 32 of the rack 18 of the support 10. The cap 24 mutually engages the at least two legs 32 of the rack 18 to suspend the at least one object secured to the base 30. In the first preferred embodiment, the cap 24 generally extends from a central portion of the top surface 30*a* of the base 30. However, it is understood by those skilled in the art that the location of the cap 24 can be modified without departing from the spirit and scope of the invention. For example, the cap 24 can be located towards an outer periphery of the base 30. Further, the hanger 14 can include more than one cap 24 to be removably engagable with the support 10.

The rod 12 vertically suspends from the support 10 when the cap 24 is engaged with the support 10 and the rod 12 is attached to the hanger 14. The cap 24 is generally square in shape, but it is understood by those skilled in the art that the form and shape of the cap 24 can be modified, such as to be circular or triangular in shape, without departing from the spirit and scope of the invention. The cap 24 includes a flange 25 extending outwardly from the rest of the cap 24. The flange 25 engages the top surface of the legs 32 of the rack 18 of the support 10 to vertically suspend the hanger 14 from the support 10. The base 30, holding prongs 26 and cap 24 are preferably integrally constructed or molded in the first preferred embodiment. However, it is understood by those skilled in the art that the components of the hanger 14 can be manufactured or constructed separately and then later combined to form the hanger 14 without departing from the spirit and scope of the invention.

Further, the hanger 14 is removably attached to the at least one object, or rod 12, by at least some form of packaging 34. In the first preferred embodiment, the packaging 34, which has an upper portion 34*a* and a lower portion 34*b*, at least partially encloses the base 30 and at least partially encloses the at least one object for removably attaching the at least one object to the base 30. The packaging 34 is preferably square in shape to accommodate the square-shaped base 30. However, it is understood by those skilled in the art that the form and shape of the packaging 34 can be modified without departing from the spirit and scope of the invention. For example, the packaging 34 can be in virtually any form or shape to generally match the shape of the base 30. The packaging 34 is preferably formed of a transparent, relatively inexpensive material, such as acetate. However, it is understood by those skilled in the art that the material used to create the packaging 34 can be modified, such as a Styrene Acrylonitrile (SAN) material, glass or a metallic material, without departing from the spirit and scope of the invention. The packaging 34 preferably provides protection to the object or rod 12 while allowing the rod 12 to be clearly visible to a consumer.

The upper portion 34*a* of the packaging 34 generally encloses the base 30. Specifically, the upper portion 34*a* of the packaging 34 engages an outer wall of the base 30 and extends around the entire periphery of the base 30. The upper portion 34*a* of the packaging 34 is preferably removably mounted to the base 30. For example, the upper portion 34*a* is preferably stapled to the base 30 to removably attach the packaging 34 to the base 30. It is understood by those skilled in the art that other means, such as adhesive, rivets, friction fitting, or other fastening means, can be used to attach the packaging 34 to the base 30 without departing from the spirit and scope of the invention. The lower portion 34*b* of the packaging 34 is preferably not attached to any structure. However, it is understood by those skilled in the art that the lower portion 34*b* of the packaging 34 can be fastened to any portion of the hanger 14 without departing from the spirit and scope of the invention. The packaging 34 of the first preferred embodiment generally surrounds and encloses an upper portion of the rod 12 to protect an enlarged head 22 of the rod 12 and to secure the rod 12 within the prongs 26 of the hanger 14.

When a manufacturer, retailer, or consumer desires to suspend an object or rod 12 from a display case 10 with the hanger 14 of the first preferred embodiment, the shaft portion 28 of the rod 12 is slid through the opening created by the two holding prongs 26. Once the rod 12 is attached to the hanger 14 within the holding prongs 26, the retailer can removably attach the upper portion 34*a* of the packaging 34 to the base 30 as described above. Now, the hanger 14 of the first preferred embodiment can be hung from a display case 10 to vertically suspend a rod 12 by sliding the cap 24 within any one of the several slots 20 without damaging the head 22 of the rod 12.

Figure 6:
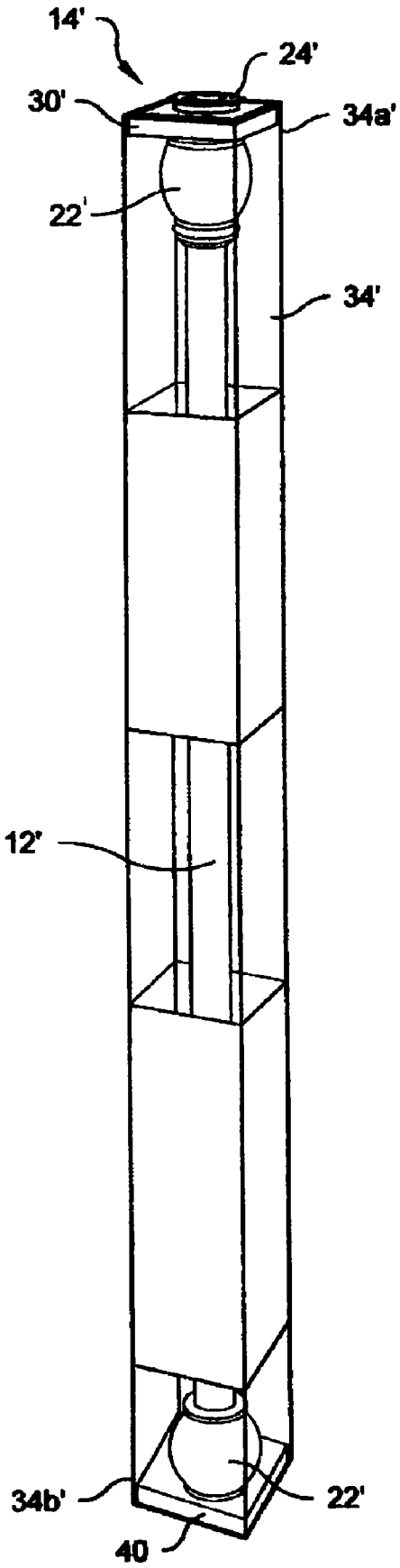
FIG. 6 is a front right perspective view of a second preferred embodiment of a hanger, packaging and a support member for enclosing at least one object in accordance with the present invention.
Figure 7:
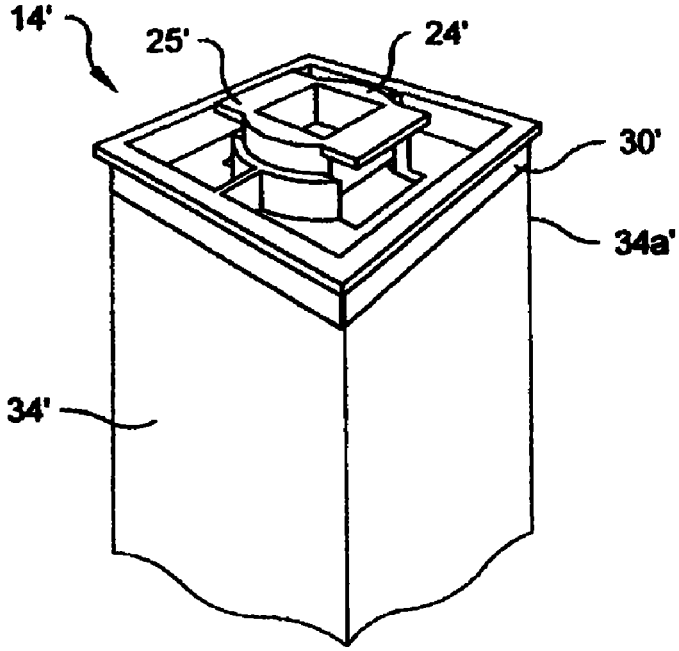
FIG. 7 is a front right perspective view of the hanger, as shown in FIG. 6, and an upper portion of the packaging thereof.
Figure 8:
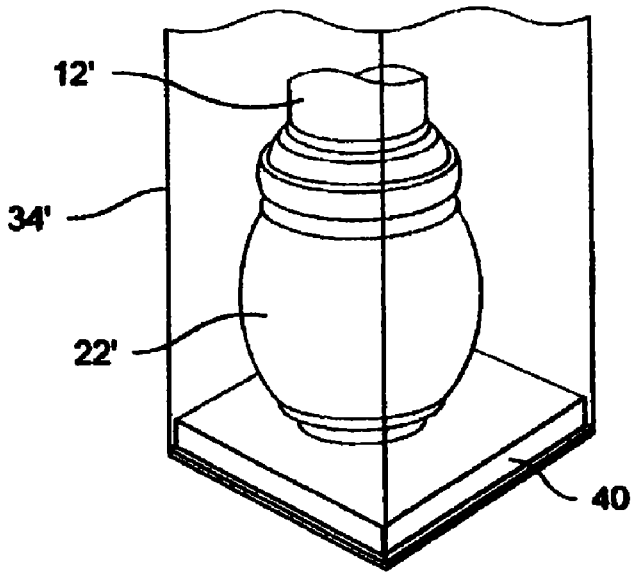
FIG. 8 is a front right perspective view of a support member, as shown in FIG. 6, and a lower portion of the packaging thereof.

In reference to FIGS. 6-8, a second preferred embodiment of a hanger 14' is shown for suspending at least one object from a support 10. Referring to FIGS. 6-8, a second preferred embodiment of the hanger 14' is shown, including like reference numerals to indicate like elements and a prime symbol (') distinguishing the reference numerals of the second preferred embodiment from the first preferred embodiment. Similar to the first preferred embodiment, the second preferred embodiment of the hanger 14' includes a base 30', a cap 24' extending from a top surface 30*a'* of the base 30' and packaging 34'. However, the hanger 14' of the second preferred embodiment further includes packaging 34' that extends the entire length of the rod 12' and a support member 40. Further, the hanger 14' of the second preferred embodiment preferably does not include any holding prongs. Instead, the at least one object or rod 12 is enclosed within the hanger 14', packaging 34' and support member 40 to suspend the rod 12 from a support 10.

Unlike the hanger 14 of the first preferred embodiment, the hanger 14' of the second preferred embodiment is not directly attached to the rod 12'. Instead, the hanger 14' of the second preferred embodiment is only attached to the packaging 34'. Specifically, the hanger 14' is directly attached to the upper portion 34*a'* of the packaging 34'. This configuration helps to the rod 12' from being damaged during shipment, sale or display of the rod 12'. In the second preferred embodiment, it is the combination of the hanger 14', the packaging 34' and the support member 40 which suspends the rod 12' from the support 10.

In the second preferred embodiment, the lower portion 34*b'* of the packaging 34' is generally located at the opposite end of the rod 12' from the hanger 14'. Specifically, the lower portion 34*b'* of the packaging 34' is preferably removably attached to the support member 40 at the opposite end of the rod 12' from the hanger 14'. The lower portion 34*b'* of the packaging 34' partially encloses the support member in a similar manner to how the upper portion 34*a* of the packaging 34 of the first preferred embodiment encloses the base 30. The lower portion 34*b'* of the packaging 34' is preferably stapled to the support member. However, it is understood by those skilled in the art that the lower portion 34*b'* can be removably mounted to the support member 40 by virtually any means, such as rivets, adhesive or friction fitting, without departing from the spirit and scope of the invention.

In the second preferred embodiment, the rod 12' is completely enclosed by the packaging 34' when the lower portion 34*b'* of the packaging 34' is attached to the support member 40. The support member 40 of the second preferred embodiment is preferably square in shape to fit within the square-shaped packaging 34'. However, it is understood by those skilled in the art that the form and shape of the support member 40 can be modified without departing from the spirit and scope of the invention. For example, the support member 40 can be in virtually any shape that can accommodate the packaging 34'. When the hanger 14' of the second preferred embodiment is suspended from the support 10, the weight of the rod 12' rests on a top surface of the support member 40. Therefore, when the rod 12' is hung from the support 10, a lower portion of the rod 12' is enfacing engaging with the top surface of the support member 40.

To attach a rod 12' to the hanger 14' of the second preferred embodiment for suspension from a display 10, a manufacturer, retailer or user encloses the rod 12' within the base 30', the packaging 34' and the support member 40. Specifically, the manufacturer, retailer or user attaches the upper portion 34a' of the packaging 34' to the base 30' while the rod 12' is enclosed therein. Next, a retailer may attach the lower portion 34b' to the support member 40 such that the rod 12' is completely enclosed within the base 30', packaging 34' and support member 40. Next, the rod 12' is ready to be suspended from the support. Specifically, the retailer can slide the cap 24' within any one of the plurality of slots 20 such that the flanges 25' can slide and eventually rest on the upper portion of any one of the plurality of legs 32. In this position, the rod 12' can be hung from the support 10 for an indefinite period until the retailer or a consumer desires to remove the rod 12' from the support 10 by sliding the cap 24' of the hanger 14' away from the display 10.

It will be appreciated by those skilled in the art that changes could be made to the embodiments described above without departing from the broad inventive concept thereof. It is understood, therefore that this invention is not limited to the particular embodiments disclosed, but is intended to cover modifications within the spirit and scope of the in present invention as defined by the appended claims.

I claim:

1. A combination support and hanger suspending an object above a supporting surface, the combination comprising:

the support including a suspension rack having at least two spaced-apart legs, each leg including a top surface and an opposing bottom surface, an orthogonally extending slot located between the at least two spaced-apart legs;

the object configured to be suspended from the support by the hanger; and the hanger including:

a base having a top surface and an opposing bottom surface, the top and bottom surfaces of the base extending generally parallel to the supporting surface when the hanger is attached to the support;

two spaced-apart holding prongs extending downwardly from the bottom surface of the base, the two spaced-apart holding prongs defining a generally circular opening therebetween, the opening being sized and shaped to receive at least a portion of the object therein; and a cap extending upwardly from the top surface of said base, the cap including a flange extending outwardly therefrom;

wherein the cap is slidably and removably positioned within the slot such that a bottom surface of the flange engages at least a portion of the top surface of each of the at least two spaced-apart legs to suspend the object secured to the base.

2. The combination support and hanger in accordance with claim 1, wherein the object is an elongated member.

3. The combination support and hanger in accordance with claim 2, wherein the elongated member is an elongated curtain rod.

4. The combination support and hanger in accordance with claim 3, the hanger further comprising packaging, having an upper and lower portion, at least partially enclosing the base and surrounding an entire periphery of the rod.

5. The combination support and hanger in accordance with claim 4, wherein the packaging is generally transparent and is configured to extend generally the entire length of the rod.

6. The combination support and hanger in accordance with claim 3, wherein a top surface of the rod is configured to be in facing engagement with the bottom surface of the base.

7. The combination support and hanger in accordance with claim 1, wherein the top and bottom surfaces of each leg extend generally parallel to the supporting surface.

8. The combination support and hanger in accordance with claim 1, wherein each leg includes a first free end and an opposing second end integrally formed with a remaining portion of the suspension rack, each of the first free end and the second end including an outer surface and an opposing inner surface facing the hanger when the hanger is attached to the support.

9. The combination support and hanger in accordance with claim 8, wherein a first distance measured between opposing inner surfaces of adjacent legs at the second end of each leg is greater than a second distance measured between opposing inner surfaces of adjacent legs at the first free end of each leg.

10. The combination support and hanger in accordance with claim 1, further comprising a plurality of laterally spaced-apart legs, wherein a slot is located between each pair of adjacent legs.

* * * * *